United States Patent [19]

Brill

[11] Patent Number: 4,571,892

[45] Date of Patent: Feb. 25, 1986

[54] METHOD OF DRESSING GRINDING WHEELS IN GRINDING MACHINES

[75] Inventor: Jürgen Brill, Stuttgart, Fed. Rep. of Germany

[73] Assignee: Schaudt Maschinenbau GmbH, Stuttgart, Fed. Rep. of Germany

[21] Appl. No.: 603,460

[22] Filed: Apr. 24, 1984

[30] Foreign Application Priority Data

Apr. 27, 1983 [DE] Fed. Rep. of Germany ..... 3315197

[51] Int. Cl.[4] ..... B24B 49/18

[52] U.S. Cl. ..... 51/325; 51/165.88; 125/11 R; 125/11 CD

[58] Field of Search ..... 51/165 R, 165.87, 165.88, 51/325; 125/11 R, 11 CD

[56] References Cited

U.S. PATENT DOCUMENTS 4,266,374 5/1981 Asano ..... 125/11 CD
4,359,841 11/1982 Barth ..... 125/11 CD
4,420,910 12/1983 Larsson ..... 51/165.88

*Primary Examiner*—Harold D. Whitehead
*Attorney, Agent, or Firm*—Peter K. Kontler

[57] ABSTRACT

In a grinding machine wherein a first carriage for the grinding wheel is movable at right angles to the axis of the grinding wheel toward and away from a second carriage which supports a dressing tool as well as the reciprocable or pivotable sensor of a distance measuring instrument and is movable in parallelism with the aforementioned axis, the grinding wheel is dressed by the dressing tool while the second carriage moves relative to the first carriage and vice versa. The distance between the periphery of the freshly dressed grinding wheel and the dressing tool is memorized in response to a signal which denotes the position of the sensor while the latter contacts the dressed portion of the grinding wheel, and the thus stored signal is used for proper positioning of the grinding wheel relative to the dressing tool preparatory to the next dressing operation.

12 Claims, 16 Drawing Figures

METHOD OF DRESSING GRINDING WHEELS IN GRINDING MACHINES

BACKGROUND OF THE INVENTION

The present invention relates to a method of dressing grinding wheels in grinding machines. More particularly, the invention relates to improvements in a method of dressing grinding wheels in grinding machines of the type wherein the grinding wheel on the one hand and a dressing tool and a sensor on the other hand are movable relative to each other so that the sensor can be brought into contact with the grinding wheel in a first step, that the dressing tool can be moved into proper position relative to the grinding wheel preparatory to start of the dressing operation, and that the dressing operation is followed by renewed placing of the sensor into contact with the freshly dressed grinding wheel.

Methods of the above outlined character are disclosed, for example, in the German-language publication entitled "Werkstatt und Betrieb 112" (1979, 9, pages 649 to 654) and in U.S. Pat. No. 4,266,374 granted May 12, 1981 to Asano et al. These conventional methods involve the utilization of a sensor in combination with a vibration detector. The grinding machine in which the method is to be carried out must be equipped with a discrete in-feed mechanism or unit for the sensor which is ground by the grinding wheel upon completion of each dressing operation. In addition, the grinding machine wherein the above outlined conventional method is to be practiced must be provided with a discrete second in-feed mechanism or unit which is designed to move the dressing tool and the sensor jointly toward or away from the grinding wheel. The provision of such mechanisms contributes significantly to the complexity, bulk and cost of the grinding machine, not only as regards its mechanical design but also as concerns the controls for various driving and other units.

OBJECTS AND SUMMARY OF THE INVENTION

An object of the invention is to provide a novel and improved method of dressing grinding wheels in grinding machines in a manner which is at least as satisfactory as but much simpler and less expensive than heretofore known methods.

Another object of the invention is to provide a method which can be practiced in a grinding machine without necessitating the utilization of expensive, bulky and complex additional equipment for the sole purpose of carrying out the dressing operation.

A further object of the invention is to provide a method which constitutes an improvement over the aforediscussed conventional method and which can be practiced by resorting to surprisingly simple and readily available distance measuring instruments.

An additional object of the invention is to provide a grinding machine which is designed for the practice of the above outlined method.

Another object of the invention is to provide the grinding machine with novel means for manipulating the grinding wheel, the dressing tool and the sensor preparatory to, in the course of, and after each dressing operation.

One feature of the invention resides in the provision of a method of repeatedly dressing or trueing the grinding wheel in a grinding machine wherein the grinding wheel is preferably movable at right angles to its axis of rotation toward and away from a dressing tool and a mobile sensor, and wherein the dressing tool and the sensor are preferably movable jointly in at least substantial parallelism with the axis of the grinding wheel. The method comprises the steps of moving the grinding wheel to or maintaining the grinding wheel in a position at a predetermined distance from the dressing tool upon completion of each dressing operation, placing the mobile sensor (e.g., by moving it at right angles to the axis of the grinding wheel) into contact with the grinding wheel while the latter is maintained at or when the latter reaches the predetermined distance from the dressing tool, memorizing the thus obtained position of the sensor, and utilizing the memorized position of the sensor as a reference value for positioning of the grinding wheel relative to the dressing tool and/or vice versa preparatory to the next-following dressing operation.

The first dressing operation can include maintaining the sensor in a starting position, moving the as yet undressed grinding wheel into contact with the sensor, dressing the grinding wheel, and thereupon ascertaining the difference between the starting position of the sensor and that position in which the sensor contacts the once-dressed grinding wheel.

The sensor can constitute a reciprocable or pivotable element of a commercially available distance measuring instrument which is preferably mounted on a carriage. The latter also supports the dressing tool (e.g., a plate or a rotary disc-shaped member) and is movable in parallelism with the axis of the grinding wheel.

The placing step can include or entail the generation of an electric or other suitable signal which denotes the position of the sensor while in contact with the grinding wheel, and the method can further comprise the step of changing the characteristics of such signal (e.g., resetting its intensity to a fixed (such as zero) value) prior to storage of the signal in a suitable memory.

If the distance measuring instrument which embodies the sensor further comprises an adjustable scale which furnishes readings indicating the positions of the sensor, the method can further comprise the step of adjusting the scale of such instrument to a predetermined position upon completion of the placing step.

The novel features which are considered as characteristic of the invention are set forth in particular in the appended claims. The improved method itself, however, together with additional features and advantages thereof, will be best understood upon perusal of the following detailed description of certain grinding machines which are designed for the practice of the method.

DESCRIPTION OF THE PREFERRED EMBODIMENTS

Figure 1:
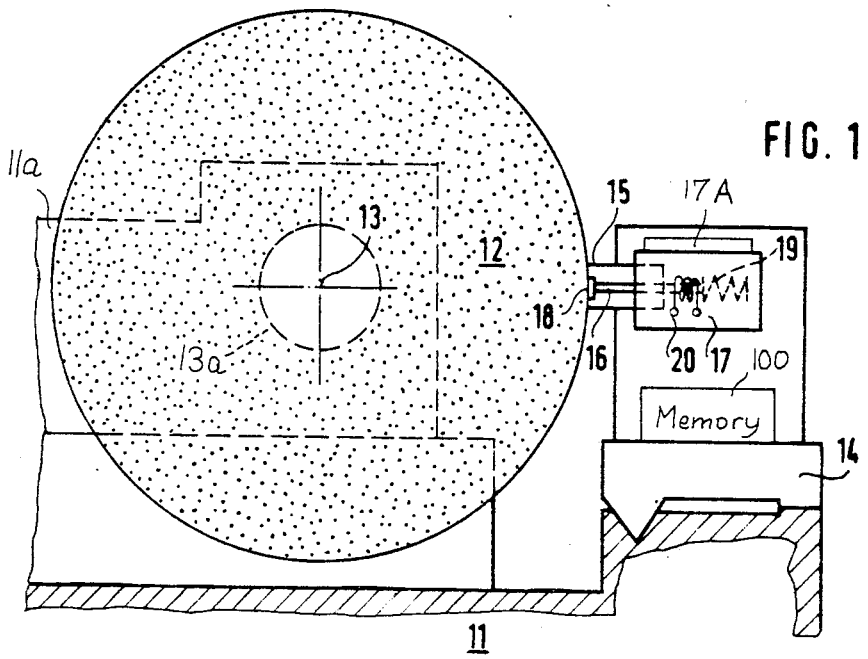
FIG. 1 is a fragmentary schematic elevational view of a grinding machine which can be used for the practice of the improved method and wherein the distance measuring instrument employs a reciprocable sensor.

FIG. 1 shows a grinding machine wherein a base or bed 11 supports a carriage 11*a* for the horizontal shaft 13*a* of a rotary grinding wheel 12. The carriage 11*a* is reciprocable in directions which are indicated by the double-headed arrow X (see FIG. 2A). The directions of reciprocatory movement of the carriage 11*a* are normal to the axis 13 of the shaft 13*a* and grinding wheel 12. The base 11 further supports a carriage 14 which is reciprocable in directions indicated by the double-headed arrow 21 (FIG. 2A) and supports a plate-like dressing tool 15 as well as a distance measuring instrument 17 of the type having a mechanical scanner or sensor 16 with a wheel-contacting head or shoe 18. The sensor 16 and its shoe 18 are movable relative to the housing of the instrument 17 in directions indicated by the double-headed arrow X. The starting or front end (extended) position of the sensor 16 with reference to the housing of the instrument 17 is adjustable and is selected in such a way that the front end face of the shoe 18 then contacts the working (peripheral) surface of the grinding wheel 12 prior to the first or foremost dressing operation when the sensor 16 is aligned with the periphery of the grinding wheel. The latter can shift the sensor 16 from such position in response to movement of the carriage 11*a* in a direction to the right, as viewed in FIGS. 1 and 2A or 2G.

The distance measuring instrument 17 further comprises a spring 19 or other suitable means for biasing the sensor 16 to its starting or front end position. Still further, the instrument 17 comprises an electromagnet (schematically represented by a coil 20) which serves to retract the sensor 16 in a direction radially of and away from the periphery of the grinding wheel 12 against the opposition of the spring 19. The distance through which the energized electromagnet 20 can retract the sensor 16 and its shoe 18 in a direction away from the periphery of the grinding wheel 12 depends upon the relationship of forces of the electromagnet 20 and spring 19. Such relationship is not critical. It is advisable to provide one or more suitable stops (not specifically shown) on the carriage 14 to arrest the sensor 16 in its extended and/or retracted position.

The mode of carrying out dressing operations in the grinding machine of FIG. 1 will be explained with reference to FIGS. 2A to 2G.

Figure 2A:
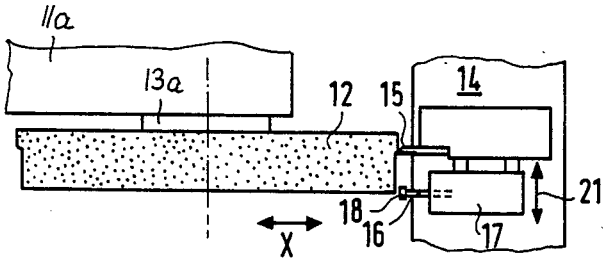
FIGS. 2A to 2G are fragmentary plan views and illustrate various stages of preparation for and actual dressing of the grinding wheel in the machine of FIG. 1.
Figure 2B:
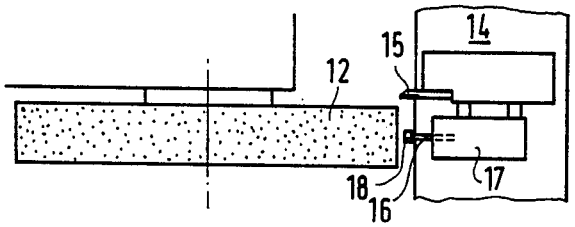

FIG. 2A illustrates the grinding wheel 12 in the process of undergoing the first or initial dressing or trueing treatment. To this end, the shaft 13*a* rotates the grinding wheel 12 about the axis 13 while the carriage 14 moves upwardly, as viewed in FIG. 2A, to enable the tool 15 to remove material from the periphery of the grinding wheel. When the first or initial dressing operation is completed, the carriage 14 is arrested in a position in which the shoe 18 of the sensor 16 is adjacent to the treated periphery (working surface) of the grinding wheel 12 (see FIG. 2B). During initial dressing, the sensor 16 is held in the retracted position by the energized electromagnet 20 (against the opposition of the spring 19) so that it preferably abuts against the aforementioned rear stop on the carriage 14. This can be readily seen in each of FIGS. 2A and 2B wherein the shoe 18 is spaced apart from the periphery of the grinding wheel 12.

In the next step, the electromagnet 20 is deenergized so that the spring 19 is free to move the sensor 16 forwardly so as to place the front end face of the shoe 18 into contact with the grinding wheel 12 (the latter does not rotate at such time to thus reduce the wear upon the shoe 18). That position (see FIG. 2C) of the sensor 16 which the latter assumes when the shoe 18 comes into contact with the periphery of the grinding wheel 12 (whose position with reference to the carriage 14 has not changed upon completion of the initial dressing operation) is thereupon memorized in a suitable memory 100 (schematically indicated in FIG. 1). For example, the instrument 17 can be designed to generate analog signals which are digitalized prior to storage in the memory 100. Alternatively, the signal which is generated by the instrument 17 at the time the sensor 16 and its shoe 18 assume the positions of FIG. 2C can be modified by being electronically set to zero. If the instrument 17 has an adjustable scale (indicated schematically at 17A) which furnishes readings denoting the positions of the sensor 16, such scale can be reset to a zero position as soon as the detection and memorizing of the position of the sensor 16 (FIG. 2C) is completed.

Of course, the modification of the signal and/or the adjustment of scale 17A need not be a zero value or zero setting, i.e., it is possible to select a value or a setting other than zero. For example, a suitable value is that which denotes the position the entire system must assume at the start of the next dressing operation. This will be explained in greater detail below.

Figure 2C:
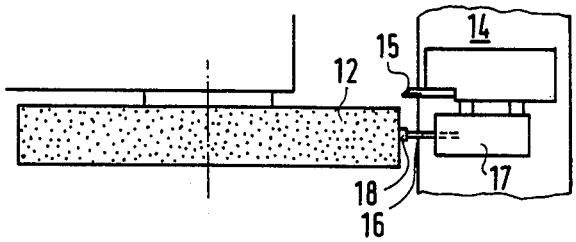
Figure 2D:
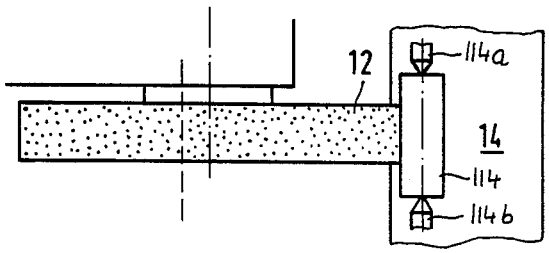
Figure 2E:
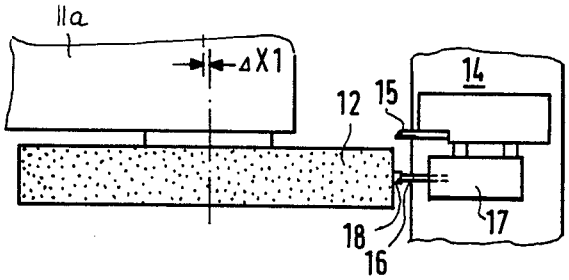
Figure 2F:
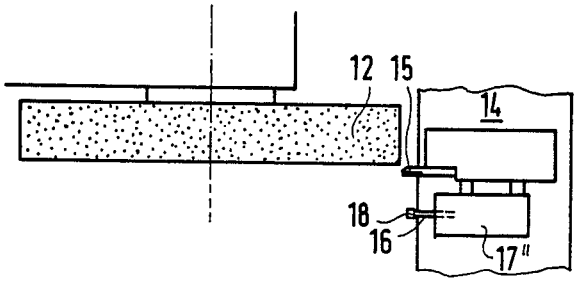
Figure 2G:
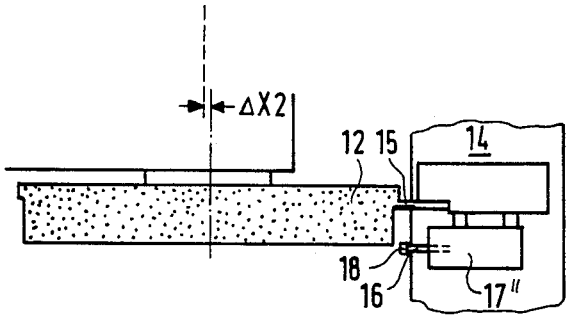

Storing or memorizing of the position of the sensor 16 as shown in FIG. 2C completes the first dressing operation, and the grinding machine is then put to use for the grinding of workpieces 114 in a manner as shown in FIG. 2D where the carriage 14 supports a workpiece 114 between two centers 214*a*, 214*b*. When the grinding wheel 12 requires renewed treatment, a new dressing cycle is initiated in the customary way. This entails a movement of the sensor 16 in front of the grinding wheel 12 as shown in FIG. 2E and the grinding wheel is moved to the position corresponding to that shown in FIG. 2C, namely to the position corresponding to or closely approaching that position of the sensor 16 which is stored in the memory 100. To this end, and once the sensor 16 is located in front of the grinding wheel 12, the carriage 11*a* is moved relative to the base 11 and toward the sensor 16 until the latter reaches the position of FIG. 2C (against the opposition of the spring 19 in the distance measuring instrument 17). The corresponding distance which is covered by the grinding wheel 12 in a direction toward the carriage 14 is indicated in FIG. 2E at X1 and denotes the extent of wear upon the grinding wheel. The corresponding position of the sensor 16 is the "zero" position or another position denoted by the signal which has been stored in the memory 100. In the next step, the electromagnet 20 is energized so as to retract the sensor 16 to its rear end position and to thus avoid unnecessary wear upon the shoe 18 during the next-following dressing of the grinding wheel 12 by the tool 15. As shown in FIG. 2F, the actual dressing operation (FIG 2G) is preceded by an idle stroke of the carriage 14 in a downward direction, as viewed in FIG. 2F, so that the dressing operation can proceed from the lower toward the upper side face of the grinding wheel 12, as viewed in FIG. 2G. The idle stroke is desirable or advantageous because it moves the dressing tool 15 to a starting position preparatory to carrying out of the dressing operation. The dressing operation involves an upward movement of the carriage 14 (with the dressing tool 15 and with the instrument 17 whose sensor 16 is then held in the retracted position by the electromagnet 20), as viewed in FIG. 2G, as well as a rightward movement of the carriage 11*a* for the grinding wheel 12 through a distance X2. If the material of the grinding wheel 12 is cubic boron nitride whose particles are held together by a suitable bonding agent, the distance X2 can be in the range of 5 micrometers. The second dressing operation of FIG. 2G is analogous to the initial dressing operation of FIG. 2A, and such second dressing operation is followed by steps which were described above with reference to FIGS. 2B and 2C.

It is also possible to proceed as follows: The so-called dressing distance (which is to be covered by the carriage 11*a* and grinding wheel 12 in the course of a dressing operation) is stored in the memory upon completion of the step which is shown in FIG. 2C (or the scale 17A is adjusted accordingly). Prior to start of the dressing operation, the grinding wheel 12 is then moved toward the carriage 14 until the memory indicates that the signal then generated by the instrument 17 matches the stored signal. The feed-in movement of the grinding wheel 12 toward the carriage 14 is terminated in immediate response to such signal and the carriage 21 is set in motion in a direction parallel to the axis 13 in order to first perform an idle stroke (so as to move the tool 15 to its starting position) or to immediately proceed with the dressing operation.

A further modification of the aforedescribed method involves immediate start of the dresing operation when the shoe 18 of the sensor 16 assumes the position of FIG. 2E, i.e., dispensing with the idle stroke. However, the thus modified method then involves the making of an idle stroke in lieu of the dressing operation of FIG. 2G. In each instance, it is normally desirable and advantageous to slightly retract the grinding wheel 12 during the idle stroke of the carriage 14 in order to avoid any contact between the periphery of the grinding wheel and the shoe 18 of the sensor 16. Of course, the controls of the grinding machine then memorize the initial position of the grinding wheel 12 (prior to retraction preparatory to the making of an idle stroke), and the position of the grinding wheel is restored (preferably automatically) as soon as the idle stroke is completed.

Figure 3A:
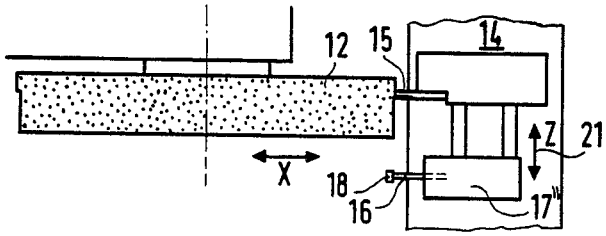
FIGS. 3A to 3G are fragmentary plan views of the grinding machine and illustrate various stages of preparation for and actual dressing of the grinding wheel in accordance with a modification of the method.
Figure 3B:
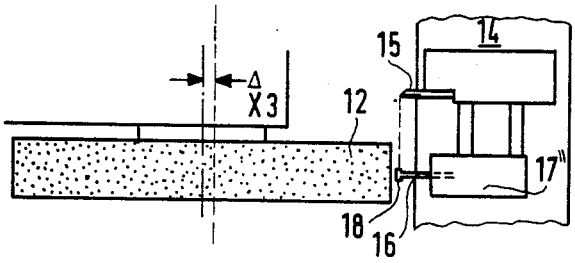
Figure 3C:
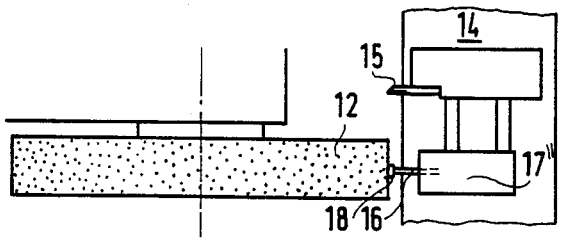
Figure 3D:
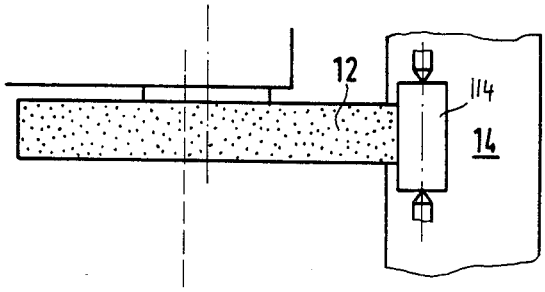
Figure 3E:
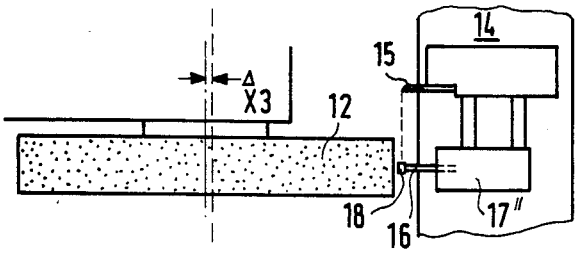
Figure 3F:
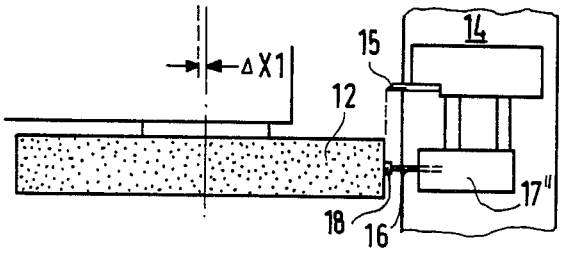

FIGS. 3A. to 3G illustrate the steps of a further method which embodies the present invention. Such method will be carried out when the instrument 17 of FIGS. 1 and 2A–2G is replaced with a simpler and less expensive instrument 17″ which does not employ an electromagnet and/or any other sensor retracting means. As shown in FIG. 3A, the initial or first dressing operation is performed in the same way as described in connection with FIG. 2A. In the next step, the grinding wheel 12 is retracted (in a direction away from the carriage 14) through a distance X3 as shown in FIG. 3B because the instrument 17″ does not have any means for retracting the sensor 16 against the opposition of the spring 19 (not shown in FIGS. 3A to 3G) or analogous biasing means. The distance X3 suffices to ensure that the spring 19 can maintain the sensor 16 in the front end (extended position and the shoe 18 still remains out of contact with the periphery of the grinding wheel 12. The grinding wheel 12 is then returned to the position of FIG. 3A (i.e., at the same distance from the carriage 14 as upon completion of the initial grinding operation) in response to a signal from the controls of the grinding machine which has memorized the position of the grinding wheel as shown in FIG. 3A. This entails a corresponding depression of the sensor 16 against the opposition of the spring 19 (see FIG. 3C), and such position of the sensor 16 is then memorized at 100 in a manner as described above in connection with FIGS. 2A to 2G. The next step constitutes grinding of one or more workpieces 114 (note FIG. 3D) in the same way as described in connection with FIG. 2D.

Figure 3G:
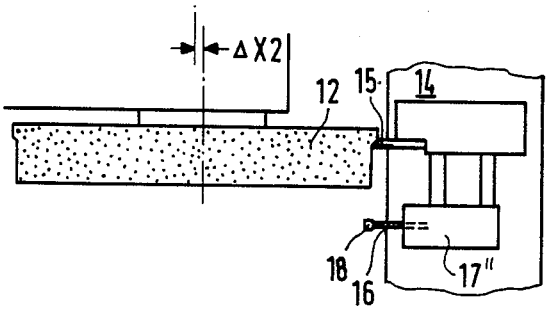

In order to proceed with the next dressing operation (after a certain interval of use of the grinding wheel 12), the sensor 16 is again moved in front of the grinding wheel (note FIG. 3E) subsequent to retraction of the grinding wheel through the aforediscussed distance X3. This ensures that the shoe 18 is out of contact with the periphery of the grinding wheel 12. The next step involves a forward movement of the grinding wheel 12 through the aforediscussed distance X3 plus the (unknown) distance corresponding to the wear upon the grinding wheel between the initial and second dressing operations (see FIG. 3F). Such forward movement of the grinding wheel 12 toward the carriage 14 is terminated when the signal which is generated by the instrument 17″ in response to depression of the shoe 18 by the grinding wheel matches the memorized signal. The sensor 16 is then moved out of the way (preferably in response to preceding retraction of the grinding wheel which is memorized by the controls of the machine) so that the shoe 18 does not rub against the grinding wheel while the carriage 14 moves the dressing tool 15 to its starting position. The carriage 11*a* is then caused to return the grinding wheel 12 to the position of FIG. 2F and the second dressing operation proceeds in a manner as shown in FIG. 3G. Retraction of the grinding wheel 12 during movement of the carriage 14 from the position of FIG. 3F to the position corresponding to the starting position of the dressing tool 15 can amount to X3, and the extent of forward movement of the grinding wheel prior to start of the second dressing operation (whose progress is shown in FIG. 3G) is through the distance X2. The idle stroke of the carriage 14 can be performed prior to or upon completion of the second dressing operation.

Figure 4:
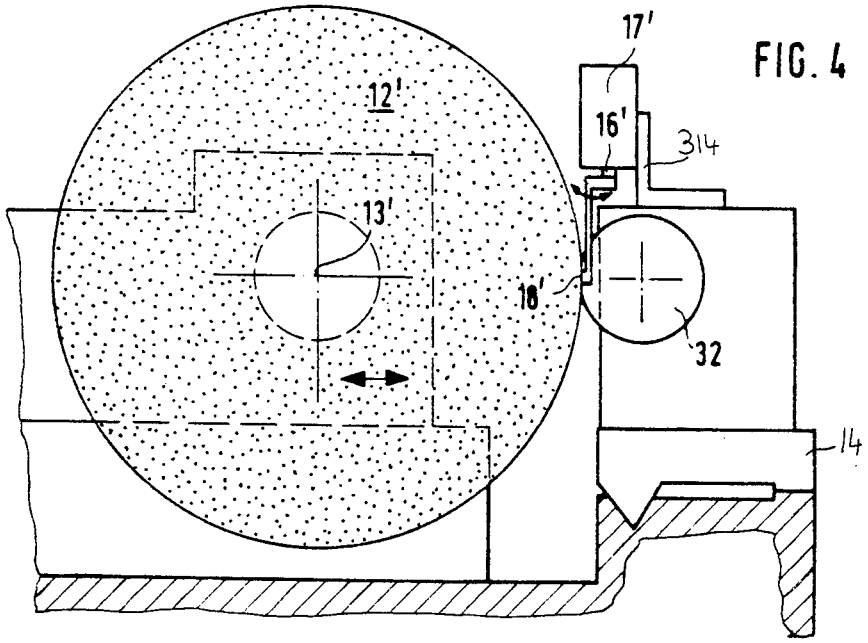
FIG. 4 is a fragmentary elevational view of a grinding machine which can be utilized for the practice of the improved method and employs a distance measuring instrument with a pivotable mechanical sensor.

FIG. 4 shows a portion of another grinding machine which can be utilized for the practice of the improved method. The distance measuring instrument 17′ is mounted on a bracket 314 of the carriage 14 in a position turned through 90 degrees with reference to the position of FIG. 1 (namely turned about an axis which is parallel to the axis 13′ of the grinding wheel 12′). The construction of the instrument 17′ can be identical with that of the instrument 17 or 17″ except that the sensor 16′ and its shoe 18′ are pivotable about an axis which is parallel to the axis 13′ of the grinding wheel 12′. The directions of back-and-forth pivotal movement of the sensor 31 are indicated by a double-headed arrow. An advantage of the instrument 17′ and its mounting is that the sensor 16′ and its shoe 18′ are more readily accessible and observable.

FIG. 4 further shows that the plate-like dressing tool 15 of FIG. 1 is replaced with a rotary disc-shaped dressing tool 32. Such rotary dressing tool can be used in the previously described grinding machine and, by the same token, the machine of FIG. 4 can employ a plate-like or otherwise configurated non-rotatable dressing tool.

In all other respects, the operation of the grinding machine of FIG. 4 is identical with or clearly analogous to that of the previous described machines.

The drawing illustrates a relatively simple grinding wheel with a smooth (constant-diameter) working surface. However, the improved method can be practiced with equal or similar advantage for the dressing of more complex grinding wheels, i.e., of grinding wheels having highly or moderately complex profile with recesses, undercuts and the like. The modifications which are then necessary for the practice of the method will be readily appreciated by those skilled in the art. Thus, the illustrated dressing tool 15 or 32 is then replaced with a differently profiled dressing tool, and the dressing will take place while the grinding wheel 12 or 12' and/or the carriage 14 moves in the direction of the double-headed arrow X. The carriage 14 can further support an additional tool, such as a "sharpening" roller of the type disclosed in U.S. Pat. No. 3,314,410 granted April 18, 1967 to Knauer et al.

It will be noted that the improved method takes advantage of the fact that a grinding machine of the type under consideration here is invariably equipped with means for feeding the grinding wheel in directions at right angles to the axis of its rotation (i.e., in directions which are indicated by the double-headed arrow X). In accordance with one aspect of the improved method, such movability of the grinding wheel in directions at right angles to its axis is utilized in connection with preparation for as well as in the course of the dressing operation or operations. Of course, this is not the sole novel feature of the improved method, i.e., in addition to the movability of the carriage 11*a* for the grinding wheel 12 or 12' in the directions indicated by the arrow X in lieu of movability of the carriage 14 in such directions, the method further involves the utilization of a surprisingly simple distance measuring instrument 17, 17'' or 17' as well as dispensal with at least one feed-in mechanism which is invariably necessary for the practice of the method disclosed in the aforementioned U.S. Pat. No. 4,266,374 to Asano et al. In fact, the sensor and the vibration detector of Asano et al. cannot be used for the practice of the present method. Thus, whereas Asano et al. proposes to grind the sensor after each and every dressing operation, the present method can be performed without such grinding of the sensor 16 and/or 16' because the head 18 or 18' of the sensor need not be in contact with the grinding wheel 12 or 12' while the latter rotates. Were the shoe 18 or 18' maintained in contact with and biased against the rotating grinding wheel 12 or 12', the useful life of such shoe would be short or very short with attendant losses in output for frequent inspection, repair and/or replacement. Moreover, the extent of wear upon the sensor and its shoe in the grinding machine of Asano et al. are highly unpredictable which would contribute to unpredictability of the dressing operation. Thus, once the sensor of Asano et al. (called detector in the patent) wears away to a small extent, the exact relationship between the positions of the periphery of the grinding wheel and the end face of the sensor cannot be ascertained with the same degree of accuracy as in the grinding machine which is used for the practice of the present method. The patentees propose to eliminate or lessen such uncertainty by grinding the sensor after each and every dressing operation with attendant losses in time and the need for frequent replacement of the entire sensor.

The cost of the distance measuring instrument 17, 17'' or 17' which is used in a grinding machine for the practice of the present invention does not exceed the cost of the sensor and vibration detector in the grinding machine of Asano et al. Moreover, the grinding machine which is used for the practice of the present invention need not be equipped with the feed-in mechanisms of the type used by Asano et al. (a) for the carriage which supports the dressing tool and the sensor and (b) for moving the sensor during grinding of the sensor upon completion of the dressing operation. Still further, the wear upon the shoe 18 or 18' of the instrument 17, 17'' or 17' is a minute fraction of wear upon the sensor in the grinding machine of Asano et al. The wear upon the sensor 18 or 18' is negligible irrespective of whether or not the corresponding instrument employs an electromagnet or other suitable sensor retracting means because the carriage 11*a* for the grinding wheel 12 or 12' is preferably retracted (and its retracted position is memorized by the controls of the grinding machine) while the carriage 14 moves the sensor 16 or 16' into and from alignment with the periphery of the grinding wheel.

The exact design of the memory 100 forms no part of the invention. Such memories are known and readily available in a wide variety of designs. Moreover, memorizing of signals or data which are generated or furnished by a distance measuring instrument is known in the art. Automatic means for varying a signal or the position of a graduated scale can include adders, potentiometers and/or other components. As mentioned above, the predetermined stored value can be zero or any other suitable value, particularly that which is used for proper selection of the dressing position preparatory to the next trueing operation. A suitable odometer is the device type "WEMAR", an odometer with amplifier and "Autozero"-device, manufactured by MARPOSS Gesellschaft für Meβsteuerungen m.b.H. in 7012 Fellbach-Schmiden, Western Germany. The "autozero-device" includes memory 100 and is connected with a control-system (not shown) for controlling the grinding machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of repeatedly dressing the grinding wheel in a grinding machine wherein the grinding wheel is movable at right angles to its axis of rotation toward and away from a dressing tool and a mobile sensor, wherein the dressing tool and the sensor are movable jointly in parallelism with the axis of the grinding wheel, and wherein the sensor is an element of a commercially available sensor type distance measuring instrument mounted on a carriage which also supports the dressing tool and is movable back and forth in parallelism with the axis of th grinding wheel, comprising the steps of locating the grinding wheel at a predetermined distance from the dressing tool upon completion of each dressing operation; placing the mobile sensor into contact with the grinding wheel while the latter is located at said predetermined distance from the dressing tool; memorizing the position of the sensor; and utilizing the memorized position of the sensor as a reference value for the position of the grinding wheel relative to the dressing tool preparatory to the next-following dressing operation.

2. The method of claim 1, wherein the first dressing operation includes maintaining the sensor in a starting position, moving the as yet undressed grinding wheel into contact with the sensor, memorizing the corresponding position of the sensor, retracting the sensor, dressing the grinding wheel, moving the sensor into contact with the dressed grinding wheel, and ascertaining the difference between the memorized position of the sensor and that position in which the sensor contacts the once-dressed grinding wheel.

3. The method of claim 1, wherein said placing step includes generating a signal denoting the position of the sensor, and further comprising the step of changing the characteristics of said signal prior to said memorizing step.

4. The method of claim 1 of repeatedly dressing the grinding wheel in a grinding machine wherein the sensor is an element of a distance measuring instrument having an adjustable scale which furnishes readings indicative of the position of the sensor, and further comprising the step of adjusting the scale of such instrument to a predetermined position.

5. The method of claim 1, wherein said placing step comprises moving the sensor by the grinding wheel.

6. The method of claim 1, wherein said placing step includes moving the sensor from a retracted position toward and against the grinding wheel.

7. The method of claim 1, further comprising the step of maintaining the sensor out of contact with the grinding wheel whenever the grinding wheel rotates.

8. The method of claim 1, further comprising the step of maintaining the sensor out of contact with the grinding wheel whenever the sensor moves in parallelism with the axis of the grinding wheel.

9. The method of claim 1, wherein the tool is a plate-like tool.

10. The method of claim 1, wherein the tool is a rotary member.

11. The method of claim 1, further comprising the step of causing the tool to perform an idle stroke in parallelism with the axis of the grinding wheel prior to or subsequent to each n-th dressing operation wherein n is a whole number exceeding one.

12. The method of claim 1, wherein said placing step includes generating electric signals denoting the position of the sensor.

* * * * *